United States Patent [19]

Sasaki et al.

[11] Patent Number: 4,804,994

[45] Date of Patent: Feb. 14, 1989

[54] COMPACT ELECTROPHOTOGRAPHIC PRINTING APPARATUS HAVING AN IMPROVED DEVELOPMENT MEANS AND A METHOD FOR OPERATING THE SAME

[75] Inventors: Sachio Sasaki; Masahiro Wanou, both of Kawasaki; Masatoshi Kimura; Junzo Nakajima, both of Yokohama, all of Japan

[73] Assignee: Fujitsu Limited, Kawasaki, Japan

[21] Appl. No.: 11,599

[22] Filed: Feb. 6, 1987

[30] Foreign Application Priority Data

Feb. 8, 1986 [JP] Japan ..... 61-026229

[51] Int. Cl.[4] ..... G03G 15/09

[52] U.S. Cl. ..... 355/3 DD; 355/14 D; 118/657; 118/658; 430/122

[58] Field of Search ..... 355/3 DD, 14 D, 3 TR; 118/657, 358; 430/122

[56] References Cited

U.S. PATENT DOCUMENTS

| | | | |
|---|---|---|---|
| 4,452,173 | 6/1984 | Tabuchi et al. | 355/3 DD X |
| 4,466,728 | 8/1984 | Schlageter et al. | 355/3 DD |
| 4,466,730 | 8/1984 | Jugle | 355/3 DD |
| 4,533,229 | 8/1985 | Lu | 355/3 DD |
| 4,559,899 | 12/1985 | Kan et al. | 355/3 DD X |
| 4,637,706 | 1/1987 | Hosoi et al. | 355/3 DD |

FOREIGN PATENT DOCUMENTS 57-119375 7/1982 Japan .

*Primary Examiner*—A. C. Prescott
*Attorney, Agent, or Firm*—Staas & Halsey

[57] ABSTRACT

A compact and simple structured electrophotographic printing apparatus having a single magnetic developer, in which an accumulation of toner particles is formed on a photosensitive member at a downstream position from the magnetic developer. The accumulation of the toner particles is formed by moving a photosensitive film and a magnetic brush in rubbing contact with the film in mutually opposite directions, or by deforming a magnetic field generated by the magnetic developer, using a magnetic piece. A recording electrode is disposed on a sleeve of the magnetic developer and facing the photosensitive film. Bias voltages, having polarities opposite to each other with respect to the photosensitive film, are respectively applied to the recording electrode and the sleeve. An optical beam is projected onto the photosensitive film in a region facing the recording electrode. Thus, with the aid of toner particles located between the recording electrode and the photosensitive film and the accumulation of the toner particles, sensitizing, developing and scavenging are carried out simultaneously, and thus a toner image is produced on the photosensitive film. For a magnetic developer having a rotatable sleeve, a specially designed recording electrode is disclosed. The photosensitve member may be in the form of a solid flat plane, a drum, or a flexible belt-like film.

19 Claims, 7 Drawing Sheets

WITHOUT TONER ACCUMULATION

WITH TONER ACCUMULATION

COMPACT ELECTROPHOTOGRAPHIC PRINTING APPARATUS HAVING AN IMPROVED DEVELOPMENT MEANS AND A METHOD FOR OPERATING THE SAME

BACKGROUND OF THE INVENTION

1. Field of the Invention

This invention relates to an electrophotographic printing apparatus and a method for operating the same. More particularly, the present invention is directed to an improved developing means for forming a toner image and an operating method thereof.

2. Description of the Related Art

There have been developed various electrophotographic printers in which a latent electrostatic image is formed by projecting an optical beam onto a photoconductive layer. By depositing toner particles on the photoconductive layer, the resulting latent electrostatic image is developed into a toner image which is thereafter transferred onto recording paper and fixed thereon.

The principles of various known methods will be described with reference to FIGS. 1–4. FIG. 1 is a block diagram of a prior art electrophotographic printing apparatus which utilizes a process referred to as the Carlson method wherein corona dischargers are employed. A photosensitive drum 101 comprising a photoconductive layer 102 (such as a selenium layer) is rotated in the direction indicated by arrow 100, and the surface of the photosensitive drum 101 is uniformly charged (positively in this case) with ions generated by a corona discharging device 103, as shown in FIG. 1. Subsequently, the photoconductive layer 102 is exposed to an optical beam, such as a laser beam, emitted from an optical image source 104. The resulting electrostatic latent image, corresponding to an object pattern to be reproduced, is developed by depositing electrostatically charged toner particles on the photosensitive layer 102, employing a magnetic brush developer 105. The toner image is electrostatically transferred to recording paper 110 which is charged at the opposite polarity of the toner particles, employing another corona discharger 106. The toner is then fixed on the recording paper 110 with an image fixer 107. The charges retained in the photosensitive layer 102 and residual toner particles remaining on the photosensitive layer 102 are neutralized by a corona discharger 108, and the discharged toner particles are wiped away by a fur brush 109. This completes one cycle of the electrophotographic printing process.

Each corona discharger requires a high voltage, such as several thousand volts, and is very sensitive to the atmospheric conditions, such as the level of humidity, dust and other contaminants contained in the air. In addition, ozone gas is generated during the corona discharge, exposing operators to a health hazard. The use of the corona discharge devices creates problems such as a high cost, an unstable printing operation, and a health hazard to the operators. To overcome the disadvantages described above, an electrophotographic device without corona discharging devices has been recently developed.

For example, an electrophotographic printing apparatus is disclosed in Japanese Laid-Open Provisional Application No. 57-119375, issued on July 24, 1982, to Y. Nishigaki. FIG. 2 is a block diagram illustrating the configuration of the Nishigaki apparatus. A photosensitive film 115 (formed of a photosensitive medium) of, for example, a transparent substrate 111, a transparent electrode 112 formed of ITO (Indium-Tin-Oxide), a photoconductive layer 113 formed of a 65 μm layer of cadmium sulfide (CdS), and a white insulator layer 114 formed of titanium oxide (TiO). The four layers are laminated to each other in the recited order to form the layered photosensitive film 115. A magnetic brush developer 116 is placed adjacent to and facing the photosensitive film 115. An optical beam is emitted from an optical image source including an optical source 117 such as a laser, a rotating polygonal mirror 118, and a lens 119. The optical beam is projected onto a portion of the photosensitive film 115 adjacent to the magnetic brush developer 116, from the transparent substrate (111) side of the photosensitive film 115, making the exposed portion of the photoconductive layer 113 conductive. Since a bias voltage is applied between the magnetic brush developer 116 and the transparent electrode 112, the photo-carriers generated in the exposed portion of photoconductive layer 113 are attracted by an electrostatic force toward the white insulator 114 and blocked thereby, forming an electrostatic latent image. Consequently, the electrostatic field between the electrostatic latent image and the magnetic brush developer 116 is fairly strong. On the other hand, the electric field across the unexposed portion of the photosensitive film (which remains non-conductive) is weak since the photoconductive layer 113 has a large thickness in comparison to the white insulator 114. Thus, charged toner particles carried by the magnetic brush developer 116 in contact with the photosensitive film 115 are attracted to the exposed portion of the photosensitive film 115 and are not attracted to the unexposed portion, forming a visual image on the photosensitive film 115. The formed toner image is transferred to a recording medium. The electric charge of the electrostatic latent image and of the residual toner particles left on the photosensitive film 115 are gradually discharged before the next printing process starts, and are collected magnetically by the magnetic brush developer 116.

Although the Nishigaki electrophotographic printing method advantageously does not require a corona discharging device employing a high voltage, a relatively thick photoconductive layer 113 is required to provide satisfactory contrast, because toner image formation is accomplished by utilizing the difference between the adhering forces generated by electric fields, namely Coulomb forces, in exposed and unexposed areas as described above. The fabrication of a thick photoconductive layer having a uniform thickness is difficult and the cost of materials is high. A reduction in the photosensitivity of the photoconductive layer 113 and an increase in the required bias voltage applied between the transparent electrode 112 and magnetic brush developer 116 occur as the thickness of the photoconductive layer 113 increases. In addition, when conductive toner particles are employed, ordinary recording paper having relatively low resistivity cannot be used as a recording medium because the charge of the deposited toner particles can be easily discharged. Thus, a specially treated medium, for example, a paper coated with an insulative layer, must be used.

A further improved electrophotographic printing apparatus which overcomes the above-described disadvantages is disclosed in allowed U.S. patent application, Ser. No. 762,431 by Kimura et al., assigned to the assignee of the present invention. FIG. 3 is a block diagram of the Kimura et al. electrophotographic printing apparatus and includes an electrophotographic printing drum 140, a first magnetic brush developer 125, a second magnetic brush developer 131, an optical image source 128, an optical discharger 137, an image transferring means 135, and an image fixer 138. A photosensitive film 124 is formed on the electrophotographic printing drum 140 and includes a transparent substrate 121, a transparent electrode 122, and a photoconductive layer 123, which are laminated to each other in the recited order. The transparent electrode 122 is grounded. The photosensitive film 124 does not have an insulator layer formed thereover for blocking photocarriers, because the photoconductive layer 123 has electrical trap potentials underneath the top surface. As a result, the thickness of the photosensitive film 124 is reduced. Such a photoconductive material is commercially available as, for example, an organic photoconductive material supplied by the Eastman KODAK Co. under model number SO-102.

The first magnetic brush developer 125 and the second magnetic brush developer 131 are separated from each other by a predetermined distance. Both magnetic brush developers are conventional, each having a rotating magnet roller and a sleeve of non-magnetic material arranged co-axially. The toner particles employed are magnetically conductive particles or magnetically non-conductive particles which are carried by magnetic particle carriers, and are supplied to the magnetic brush developers 125 and 131. The magnetic toner particles or the particle carriers are magnetized by rotating magnetic fields generated by the rotating magnet rollers, and are formed into a series of toner particle "chains" extending in the radial direction of the sleeve of the developer 125, thus forming a so-called magnetic "brush". The magnetic brush also rotates but in the opposite direction to that of the magnet roller. Bias voltages having opposite polarities are supplied from the power sources 126 and 132, respectively, and are applied to the first and the second magnetic brush developers 125 and 131. The optical image source 128 includes a self-focusing lens (a product of Nippon Plate Glass LTD, commercially available under the brand name SELFOC lens) and an LED array, and emits an optical beam.

During the printing process the printing drum 140 is rotated, in a direction indicated by an arrow 120, at a constant speed. During one cycle of rotation, the following printing steps are performed sequentially:

(1) Toner particles (negatively charged, for example) are attracted to the photoconductive layer 123 by an electric field generated by a bias voltage of negative polarity supplied from the power source 126, developing a uniformly distributed toner image 127 (a solid image) on the surface of the photosensitive film 124.

(2) The solid image 127 is moved to an exposing station 130 where an optical beam emitted from the optical image source 128 is projected onto the photosensitive film 124 from the rear side thereof, i.e., from the transparent substrate 121 side of photosensitive film 124. The exposed portions of the photoconductive layer 123 are made conductive by positive photo-carriers generated in the photoconductive layer 123. The positive photo-carriers reach a trapping potential that exist close to the top surface of the photoconductive layer 123, trapped by the trap potential and fixed therein even after the laser beam is turned off, thus, forming an electrostatic latent image 129 in the photoconductive layer 123.

(3) Using the second magnetic brush developer 131, a reverse bias (positive) voltage is applied to the developer to release the toner particles 134 deposited on the unexposed portion of the photosensitive film 124. The released particles 134 are recovered by the second magnetic brush developer 131. The majority of toner particles on the exposed portion of the photoconductive layer 123 adhere to the surface due to an electrostatic force generated by the trapped charges, even though a small portion of the toner particles may be released. Thus a visual toner image 133 is developed on the photosensitive film 124.

(4) The toner image 133 is then rotated to a transferring station where the toner image 133 is transferred to recording paper 136 by a conventional image transferring means 135, and is fixed on the recording paper 136 by a conventional image fixer 138.

(5) The trapped photocarriers forming the electrostatic latent image 129 are discharged by the optical discharger 137. The remaining toner particles 139 on the photosensitive film 124 are collected by the first magnetic brush developer. 125. Thus, the printing drum 140 is recycled to perform a new printing operation.

In the above-described photoconductive layer 123, the mobility of the photo-carriers by optical exposure is rather slow, requiring a substantial time to complete the formation of the electrostatic latent image. The exposing station 130 is necessary to facilitate such an exposure time. On the other hand, with respect to a photoconductive layer made of, for example, cadmium sulfide (CdS), selenium (SE), and photosensitive organic materials, with photo-carriers of a high mobility, there is no need to facilitate a separate exposure time, and the exposure and the first development can be performed simultaneously. This process is realized in the electrophotographic printing apparatus shown in FIG. 4. The apparatus of FIG. 4 has a further advantage in that the toner particle layer formed at the first magnetic brush developer 125 has a thicker toner image at the exposed portions than the toner particle layer at the unexposed portions, because the electric field at the exposed portions is stronger than that of the unexposed portions. As a result, some image contrast of the toner particle layer appears at this printing stage which is advantageous because it produces a denser toner image.

However, the electrophotographic printing apparatuses of FIG. 3 and FIG. 4 need two magnetic brush developers for solid image developing, producing a complicated structure that is high in cost.

A low voltage electrophotography process and a compact apparatus therefor is disclosed in U.S. Pat. No. 4,545,669, issued on Oct. 8, 1985, to Hays et al. As illustrated in FIG. 3 of the '669 Patent, the apparatus includes a single magnetic brush roller and a flexible belt-like imaging member. The toner "chains" on the magnetic brush roller are moved in the same direction as the belt-like imaging member using a driving roller system. The imaging member is flexible and deflected such that the magnetic brush roller is in contact with the imaging member, securing a contacting length therebetween sufficient to form a 'sensitizing nip', and a 'development nip' which is immediately adjacent to the sensitizing nip at a location downstream thereof. On a stationary shell or on a sleeve of the magnetic brush developer, an electrically insulated strip which serves as an electrode for the sensitizing nip, is disposed, at the upper side of the nip. In this configuration, the magnetic brush developer, in cooperation with the bias voltages, performs the functions of the exposure means, the first magnetic brush developer, and the second magnetic brush developer, described above, in the following manner: toner particles supplied to the magnetic brush developer are developed uniformly by an electric field generated by a bias voltage Vs applied to the strip, and simultaneously, an electrostatic latent image is formed on the imaging member at the sensitizer nip by a rear exposure using an optical beam emitted from an electronic imaging source. Thereafter, the toner particles deposited on non-exposed portions of the imaging member are released and scavenged (removed) by an electric field of the opposite gradient to that of the sensitizing nip, and thus a toner image is formed on the surface of the imaging member. The surface speed of the magnetic brush developer is much higher than that of the imaging member, preferably by two to four times. As described previously, a certain amount of time is necessary to create a electrostatic latent image in a photoconductive layer or to develop a toner image. Therefore, a certain distance in which there is contact between the imaging member and the magnetic brush developer is required to allow the necessary time to develop the image. In the apparatus by Hays et al., the distance is provided by utilizing the flexibility of the imaging member employed; that is, the distance in which there is contact between the imaging member and the magnetic brush developer, and thus, the time of contact, is increased by a slight pressing of the magnetic brush developer against the relaxingly tensioned flexible belt-like imaging member. However, if a solid flat imaging member, particularly a photosensitive roller, is employed, there may not be sufficient contact time between the magnetic brush developer and the solid flat imaging member to develop a toner image and scavenge the relevant toner particles. This limitation on the material useable for the imaging member is undesirable and disadvantageous.

SUMMARY OF THE INVENTION

It is an object of the present invention to provide an apparatus and a method for overcoming the above-described disadvantages.

It is a further object of the present invention to provide an improved apparatus and method for the formation of a toner image on a photosensitive medium.

It is another object of the present invention to provide a compact and simple electrophotographic apparatus employing a single sensitizing and developing device which is applicable to a photosensitive medium in the form of a drum, flat plate, or a flexible deflected plate.

It is another object of the present invention to provide an electrophotographic imaging device which can simultaneously sensitize, develop, and scavenge the surface of a photosensitive film and which can rotationally extend a contact surface between the photosensitive film and a magnetic brush applied thereto.

These and other objects of the present invention are accomplished by a compact, structurally simple electrophotographic printing apparatus with a single magnetic developer, in which an accumulation of toner particles is formed on a photosensitive member downstream from the magnetic brush developer. The accumulation of toner particles is formed by moving a photosensitive film and a magnetic brush in rubbing contact with the film in mutually opposite directions, or by deforming a magnetic field generated by the magnetic developer using a magnetic piece. A recording electrode is disposed on a sleeve of the magnetic developer facing the photosensitive film. Bias voltages with opposite polarities are applied to the recording electrode and the sleeve. An optical beam is projected onto the photosensitive film at a region facing the recording electrode. Since there exist toner particles between the recording electrode and the photosensitive film and the accumulation of toner particles, sensitizing, developing and scavenging are carried out simultaneously, and thus, a toner image is produced on the photosensitive film. For a magnetic developer with a rotatable sleeve, a specially designed recording electrode is provided. The photosensitive member can be a solid flat plane, a drum, or a flexible belt-like film.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 14(*b*) and FIG. 14(*d*) are schematic cross-sectional views of a magnetic brush developer, a photosensitive layer and a magnetic piece, illustrating a configuration of the associated magnetic toner particle layers;

DESCRIPTION OF THE PREFERRED EMBODIMENTS

Figure 5:
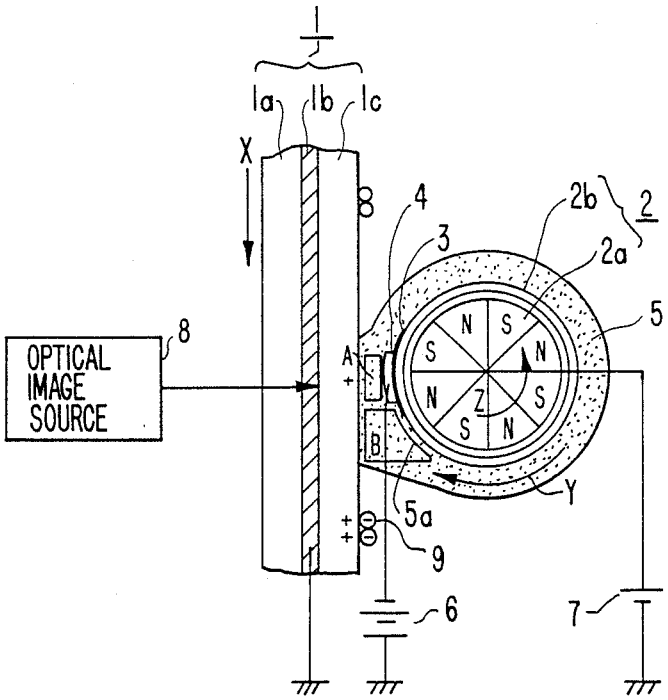
FIG. 5 is a block diagram of an electrophotographic printing apparatus according to the present invention used for explaining the principle of its structure and its operation.

FIG. 5 is a block diagram illustrating the operation of the apparatus according to the present invention. A photosensitive member 1 comprises a transparent substrate la, a transparent electrode 1*b*, and a photoconductive layer 1*c*, which are laminated to each other in the recited order. The photoconductive layer 1*c* has trap potentials beneath its top surface. Photo-carriers of one polarity (in FIG. 5, the polarity is assumed to be positive) are generated by the irradiation of an optical beam and are trapped by the trap potentials. A conventional magnetic brush developer 2 having a rotatable magnet roller 2*a*, a stationary sleeve 2*b*, and a rotatable magnet roller magnetic toner chains 5, is placed in rubbing contact with the surface of the photoconductive layer 1*c*, forming a contact region therebetween. A strip-like, e insulated recording electrode 4 which is positioned on the sleeve 2*b*. The photosensitive member 1 is moved in a direction as indicated by an arrow X, and the magnetic toner chains 5, forming a magnetic brush, are moved in a tangential direction indicated by an arrow Y. That is, the photosensitive member 1 and the magnetic toner chains 5, in contact with the photosensitive member 1, move in opposite directions to each other. A bias voltage of opposite polarity (negative in FIG. 5) to that of the photocarriers of the photoconductive layer 1*c* is supplied to the recording electrode 4 from a voltage source 6, and another bias voltage of the opposite polarity (positive in FIG. 5) with respect to the preceding bias voltage is applied to the sleeve 2*b* from a voltage source 7.

Single component developing materials of conductive toner particles, or two-component developing material containing non-conductive toner particles and magnetic toner carriers, are charged with the polarity (negative in FIG. 5) opposite to that of the photo-carriers, and supplied to the surface of the photoconductive layer 1*c*, by the magnetic brush developer 2. An optical image source 8 is disposed such that an optical beam emitted therefrom is incident on the rear side (the side of the substrate 1*a*) of the photosensitive member 1, at a spatial portion A which is facing the recording electrode 4 and is a predetermined distance therefrom. The projected beam forms an electrostatic latent image just below the surface of the photoconductive layer 1*c*. Consequently, the electrostatic field between the electrostatic latent image and the magnetic brush developer 2 is fairly strong. The photosensitive member 1 and the magnetic toner chains 5 move in rubbing contact with each other, rotationally extending the contact region therebetween; that is, an accumulation of the toner particles is caused in a spatial portion B, which accumulation is continuously distributed adjacent to the spatial portion A. In the spatial portion A, between the photoconductive layer 1*c* and the recording electrode 4, the charged toner particles are attracted by the bias voltage supplied from the voltage source 6 to both the exposed portion and unexposed portion of the photosensitive member 1, thus forming a solid image. At the exposed portion, namely, the portion corresponding to the electrostatic latent image, a thicker toner particle layer is formed than that of the unexposed portion because of the strong electrical field generated by the trapped photo-carriers, as described above. Subsequently, the solid image is moved to the spatial portion B, that is, just in rubbing contact with the accumulated toner particles, to which a bias voltage of opposite polarity to that of the preceding spatial portion A is applied. Most of the toner particles deposited on the exposed portion are still attracted by the trapped photo-carriers in the photoconductive layer 1*c* even though a small portion of the toner particles are released. On the other hand, the toner particles on the unexposed portion are neutralized by the electric field therein and released from the surface. Thus, a visual toner image 9 is formed on the photoconductive layer 1*c* which is thereafter transferred to a recording sheet (not shown). The electric charge of the electrostatic latent image and of the residual toner particles left on the photosensitive member 1 are gradually discharged until the next printing process starts, and are collected magnetically by the magnetic brush developer 2. The spatial portion A acts as a sensitizing and first developing region and the spatial portion B acts as a second developing region or a scavenging region.

Figure 6A:
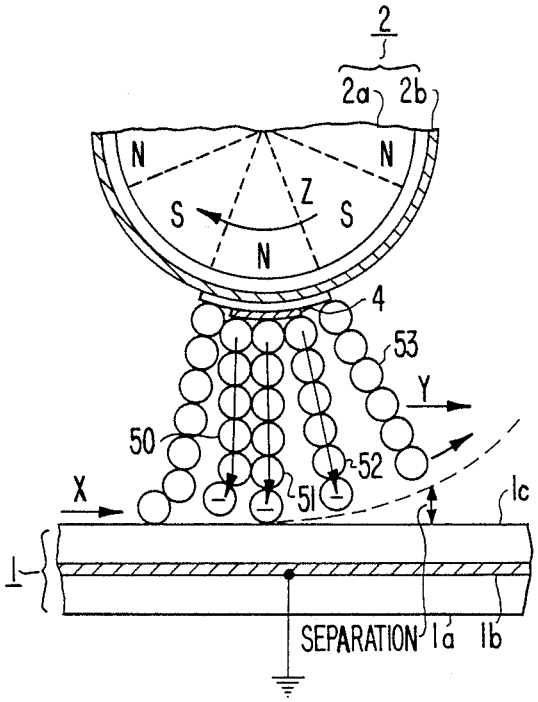
FIG. 6*a* and FIG. 6*b* are respectively partial schematic cross-sectional views of a magnetic brush developer of the present invention.
Figure 6B:
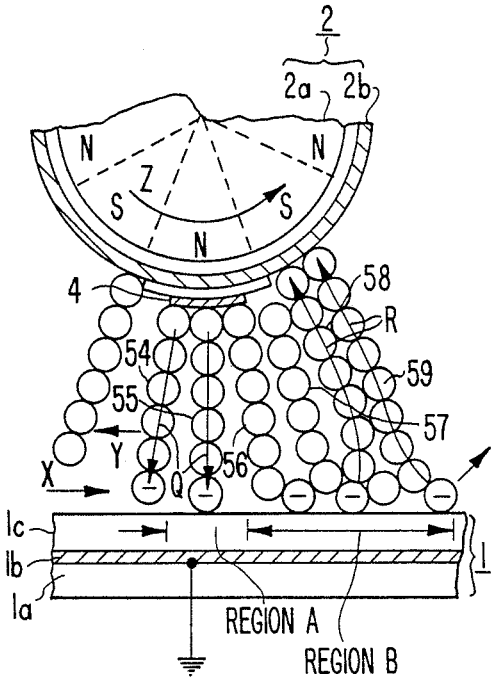

Since the accumulation 5*a* of the toner particles is a significant feature of the present invention, a more detailed description will be given of such accumulation, referring to FIGS. 6(*a*) and 6(*b*) which are partial cross-sectional views of the magnetic brush developer 2. The toner particles are assumed to be charged negatively in advance. In FIG. 6, FIG. 6(*a*) illustrates a configuration of toner chains when the magnetic toner chains 5 and the relevant photosensitive member 1 are moving in the same direction (as in a prior art electrophotographic printing apparatus), and FIG. 6(*b*) illustrates a configuration of toner chains when the magnetic toner chains 5 and the relevant photosensitive member 1 are moving in the opposite directions (as in the present invention). In FIG. 6(*a*), toner chains 50 and 51, for example, contact the surface of the photosensitive member 1 and develop a solid toner image thereon. Normally, the ends of the toner chains 5 extending radially from a sleeve 2*b* of magnetic brush developer 2, form a circular or arcuate pattern. Since there is no accumulation of the toner particles, the toner chains 52 and 53, for example, are only in contact with the surface of the photoconductive layer 1*c* for a brief moment. Accordingly, there may not be sufficient time to release or scavenge the toner particles developed on the unexposed portions of the photoconductive layer 1*c*. As a result, a clear visual toner image may not be obtained due to an insufficient contacting region being formed between the photoconductive layer 1*c* and the toner chains 5. A sufficient contacting region can be achieved only by slightly pressing the outer circle of the toner chains onto the photosensitive member 1, as Hays et al. teaches, but this is possible only when the photosensitive member 1 is flexible and deflectable. When the photosensitive member 1 is a drum, a solid flat plate, or a strongly tensioned belt-like film, increased pressure has no effect, as pointed out previously.

In contrast, as shown in FIG. 6(*b*), when the photosensitive member 1 and the toner chains 5 are moved in opposite directions, a quantity of toner particles comprising toner chains 56 through 59, for example, are accumulated due to the relatively opposed movements of the magnetic toner chains 5 and the photosensitive member 1. As a result, the length of the contacting region of the toner chains with the photosensitive member 1 is substantially enlarged. Of course, the quantity of toner particles accumulated depends on the distance between the sleeve 2b and the surface of the photoconductive layer 1c. With a proper distance, the length of the contacting region reaches, for example, up to 10 mm. Since a negative voltage is applied to a recording electrode 4, the toner particle chains 54 and 55 are attracted in a direction Q, to the photoconductive layer 1 where an electrostatic latent image is simultaneously formed, and a solid toner image is formed thereon. Therefore, the region between the recording electrode 4 and the photosensitive member 1, in cooperation with bias voltages, can be regarded as a sensitizing and first developing region, corresponding to the spatial portion A of FIG. 5. Adjacent to the above-described region another region of accumulated toner particles which is outside the range of recording electrode 4 is subject to the opposite electric field generated by a positive voltage of the sleeve 2b. The negatively charged toner particles deposited on unexposed portions of the photosensitive member 1 are attracted toward the sleeve 2b in a direction R, released from the photosensitive member 1, and recovered into a hopper (not shown) of the magnetic brush developer 2. The toner particles deposited on the exposed portions of the photosensitive member 1, are also attracted toward the sleeve 2b, but are much more strongly attracted toward the photosensitive member 1 by photo-carriers trapped in the photoconductive layer 1c. As a result, a small portion of the toner particles on the photosensitive member may be released, but most of the toner particles deposited on the exposed portion still remain. By producing an accumulation of toner particles, the functional region, including a sensitizing and first developing region, and a second developing or scavenging region, is extended to a length sufficient to form a clear toner image on the photosensitive member 1.

Figure 7:
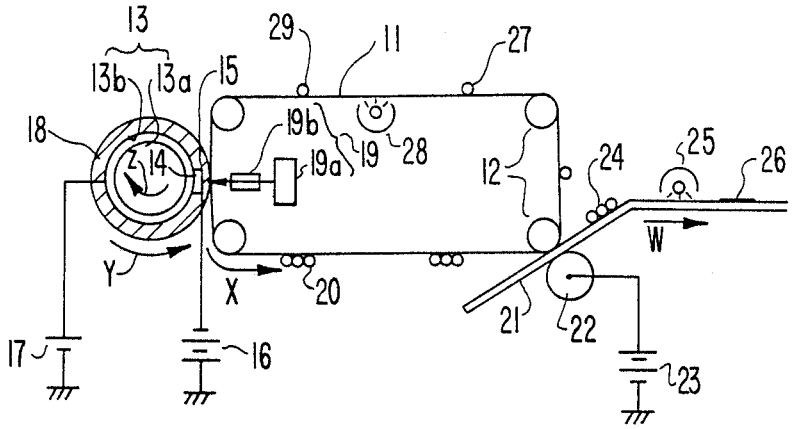
FIG. 7 is a block diagram of a first embodiment of the present invention.
Figure 8:
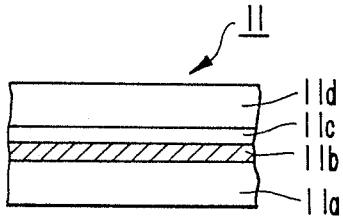
FIG. 8 is a cross-sectional view of a photosensitive film employed in the electrophotographic printing apparatus of FIG. 7.

FIG. 7 is a block diagram of a first embodiment of the present invention. A circulating photosensitive film 11 (the details of which are shown in FIG. 8) includes a transparent substrate 11a made of telepolyethylene phthalate (100 μm thick), a transparent electrode 11b formed of ITO (Indium-Tin-Oxide), and an organic photoconductive layer (10 μm thick), composed of a carrier generating layer (CGL) 11c of phthalocyanine and a carrier transfer layer (CTL) 11d of oxazole. All of the above-mentioned elements are laminated to each other in the recited order, as shown in FIG. 8.

Figure 2:
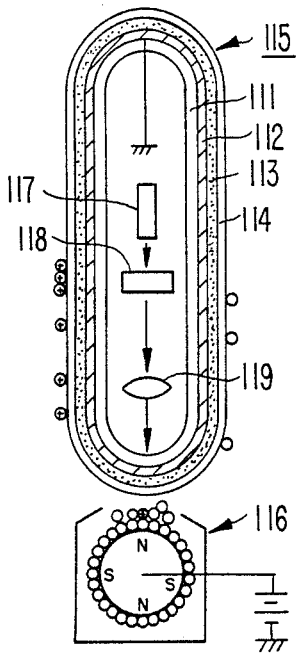
FIG. 2 PRIOR ART
Figure 3:
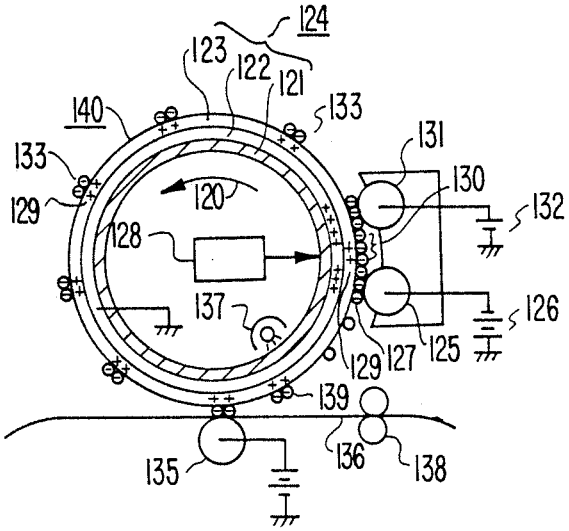
FIG. 3 PRIOR ART
Figure 4:
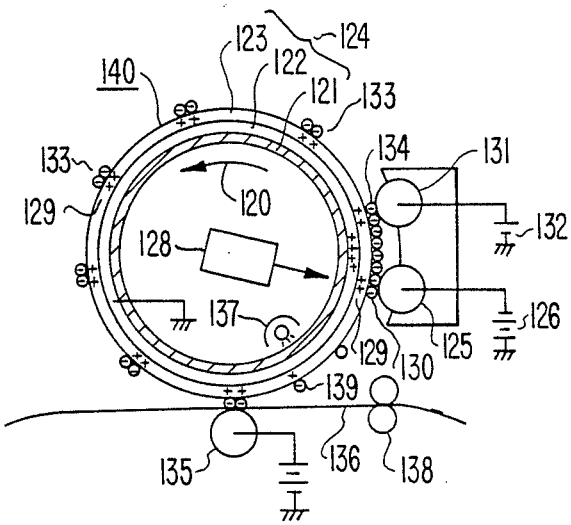
FIG. 4 PRIOR ART

Although not illustrated in FIG. 8, the photosensitive member 11 may be covered by a thin protective film layer for protecting the surface of the photosensitive member 11 from mechanical damage. The film layer is, for example, 1 μm thick and made of a resistive material having a resistivity from $10^{10}$ to $10^{13}$ Ω/cm, such as titanium oxide. A photosensitive member with an insulator layer atop the member, as shown in FIG. 2, is also suitable. The above-described configurations including the protective layer or insulator layer atop the surface of the member are also applicable to the subsequent embodiments described herein.

Figure 9:
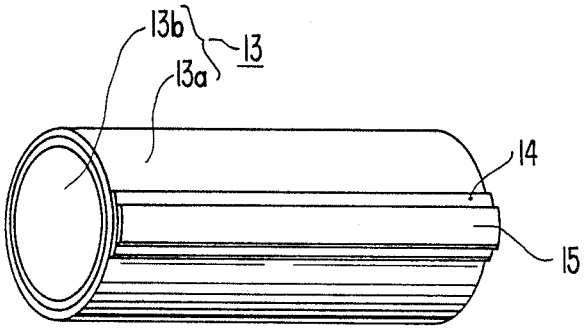
FIG. 9 is a perspective view of the strip-like recording electrode 15 of FIG. 7.

The transparent electrode 11b is electrically grounded, and the photosensitive film 11 is circulated (in a direction indicated by arrow X) by a driving roller 12, which is driven by a driving source (not shown). An ordinary magnetic brush developer 13 includes a stationary sleeve 13b, a magnet roller 13a which is rotatable in a rotating direction Z inside the sleeve 13b, and a magnetic brush of toner chains 18, which are rotated in a direction Y. The photosensitive film 11 and the magnetic toner chains 18 move in directions opposite to each other at the contact point. A strip-like- recording electrode 15, 1 to 5 mm in width, is attached to the sleeve 13b parallel with the axis of the sleeve 13b, and is insulated from the sleeve 13b by a polyimide film 14, as shown in FIG. 9.

Since photo-carriers of the photosensitive film 11 are holes, a negative bias voltage ranging from −100 V to −500 V, preferably, from −150 V to −300 V., is applied to the recording electrode 15 from a first voltage source 16. On the other hand, a positive bias voltage ranging from 0 V to +50 V, preferably, from +10 V to +30 V, is applied to the sleeve 13b from a second voltage source 17. Negatively charged conductive magnetic toner particles 18 with a preferable toner resistivity of $10^2$ to $10^{10}$ Ωcm are supplied to the magnetic brush developer 13. An optical image source 19 is disposed such that a rear exposure is possible, and the optical axis of an LED array 19a is incident perpendicularly on the longitudinal center line of the recording electrode 15. The electrophotographic printing apparatus of the first embodiment includes a conventional transfer means including a transferring roller 22 of a conductive rubber material, a third voltage source 23, a thermal fixer 25, and an optical discharger 28. The third voltage source 23 supplies a bias voltage, ranging from +200 V to +600 V, to the transferring roller 22 which is pressed mechanically toward the recording paper 21 and the photosensitive film 11, and is supported by a guide roller 12. The recording paper 21 is moved in a direction W.

The printing process is described below. The photosensitive film 11 and the magnetic toner chains 18 are driven in the directions X and Y respectively, forming an accumulation of negatively charged toner particles as illustrated in FIG. 6(*b*). The recording electrode 15 and the sleeve 13b are respectively negatively and positively biased. Consequently, on the top surface of the photosensitive film 11, there is formed a function region including a region A for sensitizing and providing a first developing process, and a region B for a second developing or scavenging process. The region B is positioned adjacent to the region A at a position downstream of the movement of the photosensitive film 11. An optical beam, emitted from the optical image source 19, is projected onto the photosensitive film 11 at the region A (see FIG. 6(*b*)) from the rear side of the photosensitive film, namely from the side of the transparent substrate 11a. An electrostatic latent image in the CTL layer 11d, just under its top surface, strongly attracts toner particles on the exposed portions. At the same time, the electric field generated by the negative bias voltage attracts the toner particles onto the exposed and unexposed portions of the photosensitive film 11, forming a solid toner image. As soon as the solid image is advanced into the region B (see FIG. 6(*b*)), a bias voltage is supplied from the second voltage source 17 to the sleeve 13b, attracting the toner particles of the solid image thereto, releasing the toner particles developed on the unexposed portions as well as a small portion of the toner particles on the exposed portions. The released toner particles are collected and scavenged by the magnetic brush developer 13. Thus, there is formed a visual, clear toner image 20 which is then processed in a conventional manner by transferring the image onto the recording paper 21 with the aid of the transferring roller 22, and fixing the image on the recording paper 21 using the thermal fixer 25, to form a permanent toner image 26. Residual toner particles 27 left on the photosensitive film 11 after transferring the toner image 20 to the recording paper 21, are neutralized by the optical discharger 28 and magnetically collected by the magnetic brush developer 13. The photo-carriers and residual charge contained in and/or on the photosensitive layer 11 are neutralized by the optical discharger 28. Thus, an electrophotographic printing cycle is completed.

Figure 10:
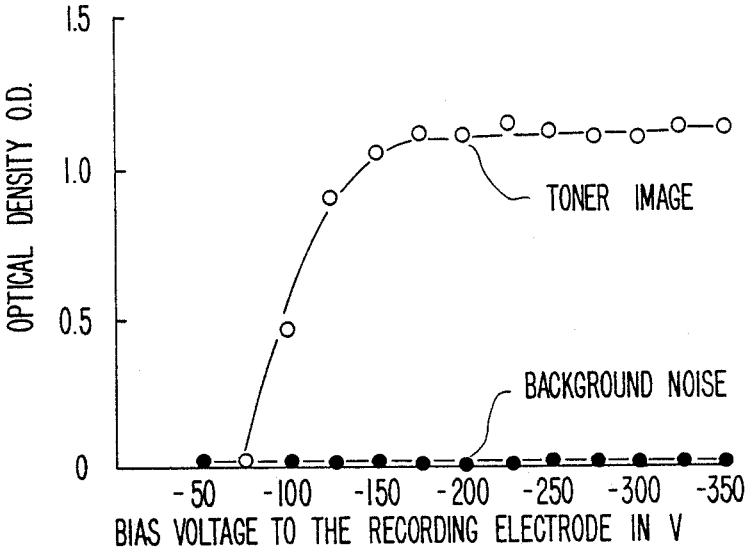
FIG. 10 is a diagram illustrating a relationship between a bias voltage applied to the recording electrode 15 and the optical density of printed toner images.
Figure 11:
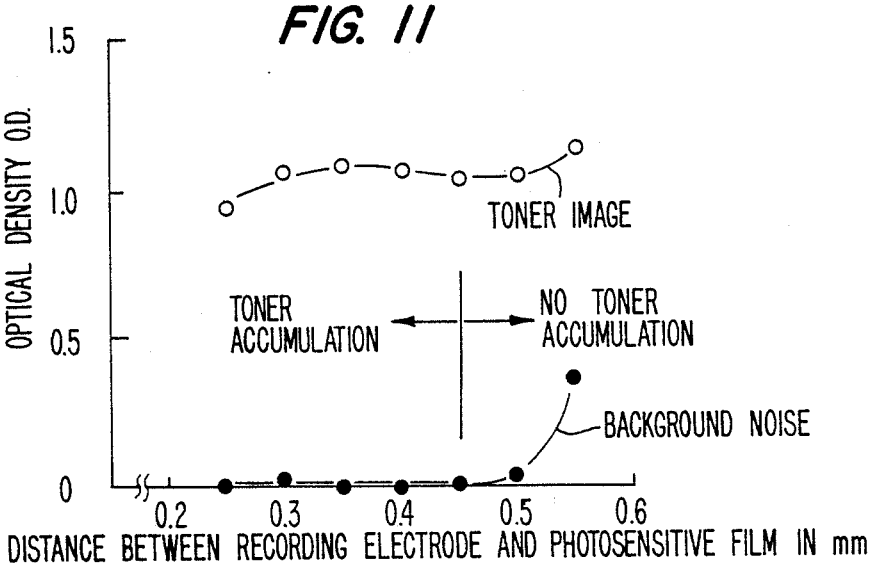
FIG. 11 is a diagram illustrating the relationship between the distance in millimeters between the recording electrode 15 and the top surface of the photosensitive film 11, and the optical density of the printed toner images and that of the associated background noise.
Figure 12:
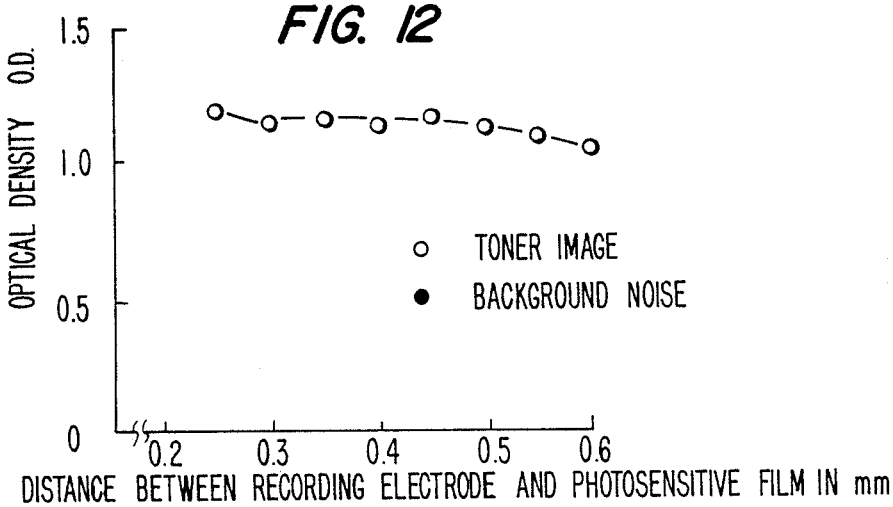
FIG. 12 is a diagram illustrating a relationship between the distance in millimeters between the recording electrode 15 and the top surface of the photosensitive film 11, and the optical density of the printed toner images and that of background noise, with respect to experiment print.

FIG. 10, FIG. 11 and FIG. 12 are graphs illustrating empirical results for the electrophotographic printing apparatus of FIG. 7. The graph of FIG. 10 illustrates a relationship between the value of the bias voltage (in volts) applied to the recording electrode 15 and the optical density of printed toner images, wherein the bias voltage of the sleeve 13*a* is +15 V, the resistivity of the relevant toner particles is $10^6$ Ωcm, the motive speed of the photosensitive film 11 is 5 cm/sec, the width of the recording electrode 15 is 3 mm, and the distance between the surface of the photosensitive layer 11 and the recording electrode 15 is 0.35 mm. As can be seen from the graph, a recording voltage of at least 150 V is sufficient to assure a high quality printing image having an optical density (OD) value higher than 1.0 with no background noise. This indicates that the accumulation of the toner particles provides a length in the direction of movement sufficient to provide an electric field for scavenging along with a mechanical rubbing effect on the photosensitive layer 11 in region B to collect the scavengable toner particles.

FIG. 11 is a graph illustrating a relationship between the distance between the recording electrode 15 and the top surface of the photosensitive film 11 in millimeters, and the optical density of the printed toner images and of the associated background noise. When the distance is greater than 0.45 mm, the OD value of the background noise increases very rapidly. This implies that too large a distance fails to cause an accumulation of the toner particles, resulting in loss of the capability of collecting the scavengable toner particles.

An experiment print was carried out regarding the electrophotographic printing apparatus of the first embodiment, in which the photosensitive film 11 and the magnetic brush including toner chains 18 were moved in the same direction at the region A in the same manner as the apparatus of Hays et al. In this experiment, no accumulation of the toner particles occurred in the region B. FIG. 12 is a graph illustrating a relationship of the distance between the recording electrode 15 and the top surface of the photosensitive film 11 in mm, and the optical density of the printed toner images along with the background noise produced in the experimental printing. For a distance ranging from 0.25 mm to. 0.45 mm (for which desirable results were obtained in the preceding experiment as shown in FIG. 11) substantially undesirable results are obtained. That is, the OD values of the printed toner images and that of the associated background boise are almost the same. This results in a lack of contrast on the printing paper, and is ascribed to the lack of the accumulation of the toner particles used for picking up the scavengable toner particles.

The results described above contradict the results professed by Hays et al. The contradiction is considered to be ascribed to the fact that, unlike the electrophotographic printing apparatus of Hays et al., the photosensitive film 11 of the present invention is tensioned tightly, allowing only a small contact arc between the photosensitive film 11 and the magnetic brush 18.

The photosensitive member 11 of the above-described first embodiment is assumed to be a belt-like flexible photosensitive film as shown in FIG. 7. However, the present invention is applicable to a printing apparatus having a photosensitive member in a shape of a solid plane, or a drum. In fact, with respect to a modified electrophotographic printing apparatus of the first embodiment having a photosensitive printing drum with an outer diameter of 142 mm and a magnetic brush developer having a sleeve with an outer diameter of 30 mm and toner chains which are 0.5 mm long, practically the same results are obtained as those illustrated in FIGS. 10 to 12.

An electrophotographic printing apparatus of the first embodiment requires an accurate setting of the gap distance, such as from 250 μm to 500 μm, between the photosensitive film 11 and the recording electrode 15, requiring the associated operator to have delicate adjustment and maintenance skills. This may be a disadvantage.

Figure 13:
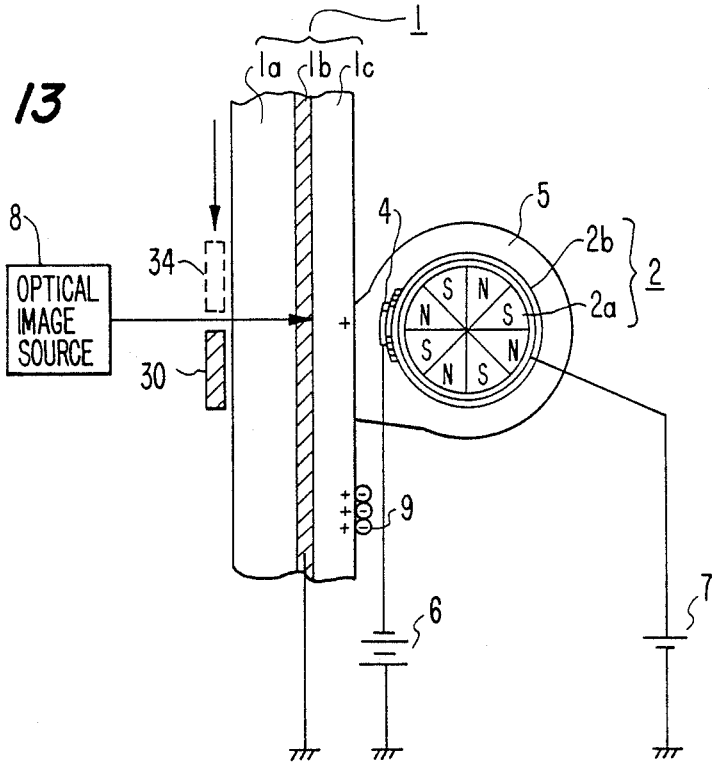
FIG. 13 is a block diagram of a second embodiment.

Hereinafter is disclosed an electrophotographic printing apparatus of a second embodiment of the present invention for overcoming the above-described disadvantage of the first embodiment. FIG. 13 is a block diagram of a printing apparatus of the second embodiment, illustrating the principles thereof. In comparison with the apparatus of the first embodiment, the apparatus of the second embodiment additionally includes a magnetic field modifying means 30 (a rectangular magnet, for example) which is placed on a side of the photosensitive member 1 opposite to that of magnetic brush developer 2. Consequently, the shape of the magnetic flux lines emanating from the rotating magnet roll 2*a* are modulated such that the magnetic flux lines are concentrated around the magnetic field modulating means 30.

The resulting magnetic flux and toner particle distribution is illustrated in schematic cross-sectional views FIG. 14(*a*) to FIG. 14(*d*) wherein like reference numerals denote like parts in accordance with FIG. 5. As can be seen from FIG. 14(*a*), magnetic flux lines 31, which extend in a loop shape from the magnet roll 2*a*, are attracted to the magnetic field modulating means 30 and concentrated at the edges thereof. As a result, the magnetic flux lines 32 passing through a region corresponding to the region B indicated in FIG. 5 are also densely concentrated in this region. Consequently, bundles of magnetic flux lines are elongated and densely formed toner chains are formed as illustrated in FIG. 14(*b*). Thus, a sensitizing and first developing region A', and a second developing or scavenging region B' positioned downstream of the movement of the photosensitive member 1 from the region A', are formed by the deformed magnetic field produced by the magnetic field modulating means 30. These accumulations of the toner particles are formed magnetically, not mechanically. In the second embodiment, therefore, the directions of movement of the photosensitive member 1 and the magnetic brush 5 or the magnetic developer 2 are not limited in any manner. In addition, the distance between the recording electrode 4 and the photosensitive member 1 is not critical. In fact, with a distance greater than 450 μm, there is no background noise. A distance as great as 1.5 mm has been confirmed as effective. Of course, the magnetic field modulating means 30 is not limited to one magnet, or a rectangular one. Any magnetic piece sufficient to form an adequate magnetic field for forming the region A′ and region B′ is applicable.

Furthermore, by placing a second magnetic field modulating means 34 adjacent to the first magnetic field modulating means 30 as illustrated by dotted lines in FIG. 13, another region C′ of accumulated toner particles is formed, as shown in FIG. 14(*d*). The region C′ is located at a position upstream of the movement of the photosensitive member 1 from the region A′, and is useful for collecting residual toner particles still remaining on the photosensitive member 1 after the image transfer from the photosensitive member 1 to a recording paper (not shown). FIG. 14(*c*) illustrates the relevant magnetic field configuration including another bundle of magnetic flux lines 33. The accumulation of toner particles, or the region A′, region B′, or region C′ may be formed close to each other or separated from each other. The essential condition required for printing is that each region should have a length sufficient to provide enough time for implementing the assigned functions such as sensitizing, developing, or scavenging.

Figure 1:
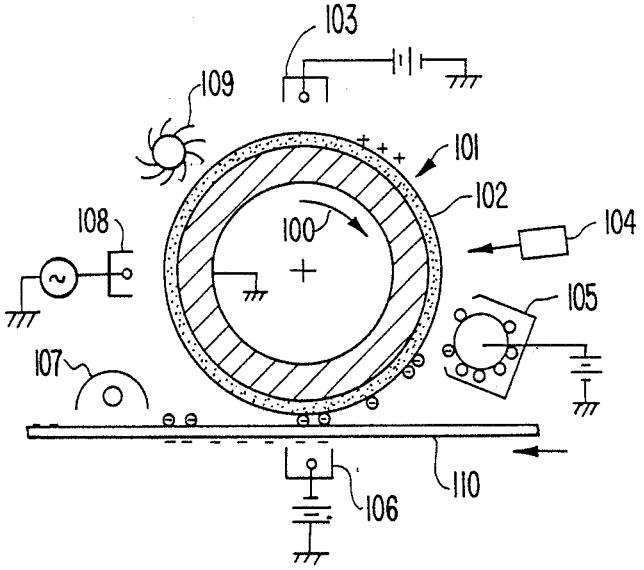
FIG. 1 PRIOR ART
FIGS. 1 to 4 are block diagrams of prior art electrophotographic printing apparatuses.
Figure 15:
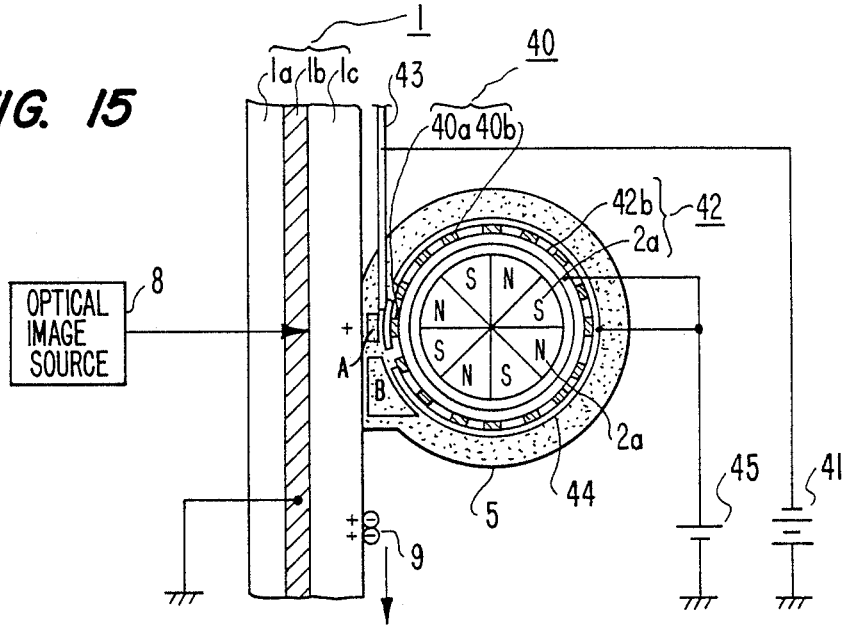
FIG. 15 is a schematic cross-sectional view of an electrophotographic printing apparatus of a third embodiment of the present invention.
Figure 14A:
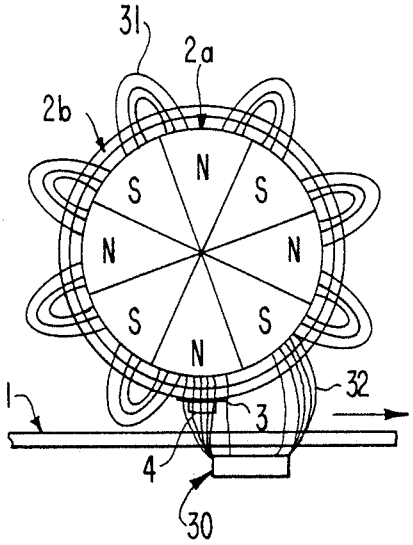
FIG. 14(*a*) and FIG. 14(*c*) are schematic cross-sectional views of a magnetic brush developer, a photosensitive layer and a magnetic piece, illustrating a configuration of an associated magnetic field.
Figure 14B:
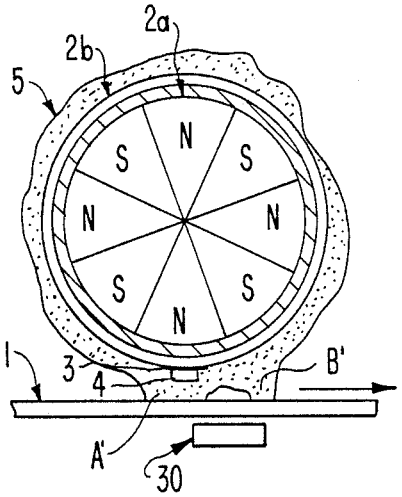
Figure 14C:
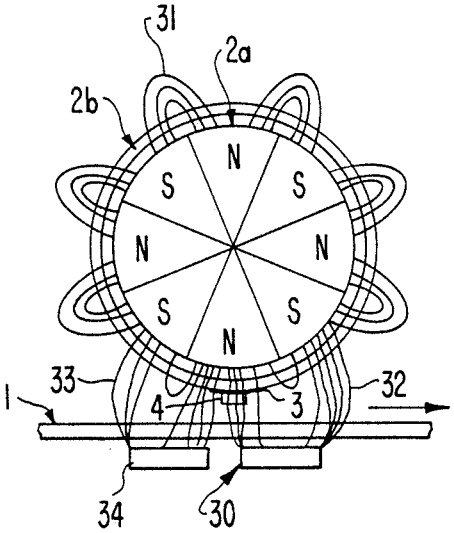
Figure 14D:
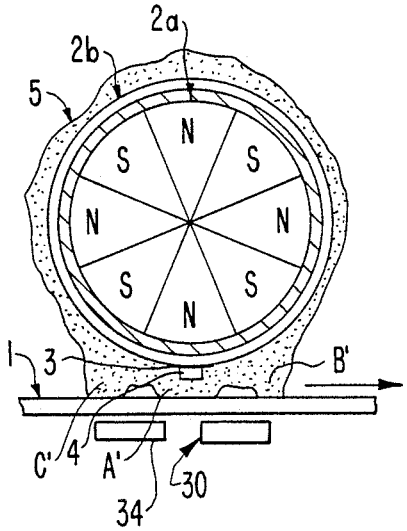

FIG. 15 is a schematic cross-sectional view of an electrophotographic printing apparatus of a third embodiment of the present invention. With respect to FIG. 1, like reference numerals designate like parts. Before proceeding further, a brief description of the toner particles will be provided. As described previously, there are two types of toner particles employed in the present invention: single-component magnetically conductive toner particles, and two-component magnetically non-conductive toner particles. The single-component magnetically conductive toner particles are applicable to the printing apparatuses of the first and second embodiments wherein a stationary sleeve is used, because toner chains are easily formed by a fairly low magnetic field intensity generated by the rotating magnet roller of the relevant magnetic brush developer. However, in a humid environment, ordinary recording paper cannot be used because the moisture in the air reduces electrical resistance of the surface of the recording paper. As a result, the electric charges of the toner image and the recording paper are discharged, accompanied by a flawed toner image flow and a low quality toner image. Accordingly, conductive toner particles are not suitable for obtaining a high quality printing image in a humid environment when ordinary recording paper is used.

In contrast, the use of non-conductive toner particles has the advantage of enabling the use of ordinary recording paper, because the toner charges are secured by an insulative thin film covering the surface of the toner particles regardless of the electrical surface resistance of the recording paper. However, the non-conductive toner particles must be transferred with the aid of toner carriers with which the non-conductive toner particles are mixed uniformly, in order to distribute the toner particles over each carrier particle. The carriers are usually small, ball-shaped particles of approximately 10 to 15 μm in diameter. The materials of the carriers are iron, ferrite, etc. for carriers of high magnetism, and magnetic resins for carriers of low magnetism. With low magnetism carriers, toner chains or magnetic brushes are easily rotated in accordance with the magnetic field generated by the rotating magnet roller. Consequently, a stationary sleeve is usable, however, there is a disadvantage in that the carriers tend to be transferred onto the associated photosensitive member, causing background noise thereon. In contrast, carriers with high magnetism are not transferred onto the photosensitive member. However, chains of high magnetic carriers are not rotated by the rotating magnetic field. This is due to the fact that the magnetizing direction of high magnetism particles changes quickly in response to the change of external magnetic field. In addition, the non-conductive toner particles attached to the carriers tend to be shifted toward the sleeve of the magnetic brush developer, forming a layer of the toner particles thereon. Therefore, a sleeve is placed rotatably within the magnetic brush developer in order to rotate the carrier chains, and scrape the layer of the toner particles occasionally, with the aid of an associated cutter blade. This configuration of the magnetic brush developer is well-known. In this case, however, the recording electrode proposed in the first and second embodiments of the present invention is not applicable because the electrode is forced to rotate with the sleeve.

To overcome the above-described problem, a specially designed recording electrode is disclosed in an electrophotographic printing apparatus of a third embodiment. FIG. 15 is a cross-sectional block diagram illustrating the principle of the third embodiment. Except for a rotatable sleeve 42*b*, recording electrodes 40*a* and 40*b*, and the associated feeding means 43 and 44, the configuration of FIG. 15 is the same as that of FIG. 5, wherein like reference numerals denote like parts.

A magnetic brush developer 42 includes a rotatable magnet roller 2*a* and a rotatable sleeve 42*b* arranged co-axially. On the surface of the sleeve 42*b*, a plurality of stripe-like recording electrodes 40 are formed mutually in parallel in the longitudinal direction of the sleeve 42*b* and at a predetermined circular pitch. Each electrode 40 is electrically isolated from the sleeve 42*b* by an insulator film. In line with the recording electrodes 40, a recording contact terminal 43 and a second developing or scavenging contact terminal 44 are arranged as shown in FIG. 15. Both contact terminals are stationary. The contact terminal 43 is for feeding a recording bias voltage supplied from a recording bias voltage source 41 to a recording electrode 40, which moves into a region A, a sensitizing and first developing region as described before (the electrode 40 is designated by a reference numeral 40*a* for clarity). The contact terminal 44 is for feeding a scavenging bias voltage supplied from a scavenging bias voltage source 45 to the other recording electrodes 40 other than the electrodes 40*a* (the electrodes are designated by a reference numeral 40*b*). The polarity of the recording bias voltage (negative voltage in FIG. 15, for example) is opposite to that of photo-carriers of the relevant photoconductive layer 1*c*. The recording bias voltage is applied to the electrode 40*a* through the contact terminal 43. The scavenging bias voltage, having the same polarity as that of the photocarriers, is applied to the electrodes 40*b* through the contact terminal 44.

At a portion of a photosensitive film 1 facing the region A, an electrostatic latent image is formed by a rear exposure to an optical beam which is emitted from an optical image source 8 (a laser optical system, an LED array optical system, or a liquid crystal shutter optical system, etc.). Two-component toner particles, including carriers of ferrite particles (10 μm in average diameter) and non-conductive toner particles, are supplied to the magnetic brush developer 2 and are transferred into a region A existing between the photosensitive member 1 and the magnetic brush developer 2. When a recording electrode 40 comes into the region A and is in contact with the contact terminal 43, a recording bias voltage, ranging from −100 V to −700 V, preferably from −500 V to −600 V, is applied to the region A, depositing toner particles on both exposed and unexposed portions of the photosensitive layer 1. Thus, the first developing process is carried out. However, if the recording electrode 40 is not moved into the region A, the first developing process cannot be implemented. It is therefore desirable to perform the formation of the electrostatic latent image by synchronizing the developing with the movement of the recording electrodes, namely, with the rotation of the sleeve 2*b*, in order to achieve a high quality printed toner image. Of course, the electrodes 40 and the contact terminal 43 can be designed such that one or two recording electrodes 40 are always activated. As a result, the synchronization described above might be unnecessary, however the recording electric field applied to the region A may swing cyclically, resulting in lower printing quality.

Subsequently, the second developing process is carried out in the region B under the application of a bias voltage, ranging from 0 to +100 V, preferably from +20 to +50 V, to the contact terminal 44. The printing process which follows the second developing is the same as that for the first and second embodiments.

The recording electrodes and the relevant contact terminals described above are applicable to an electrophotographic printing apparatus according to the present invention, which employ a rotatable sleeve of an associated magnetic brush developer. Thus, two-component toner particles, including carriers made of ferromagnetic material, may be used, thus achieving a high quality printing image on ordinary recording paper.

Figure 16:
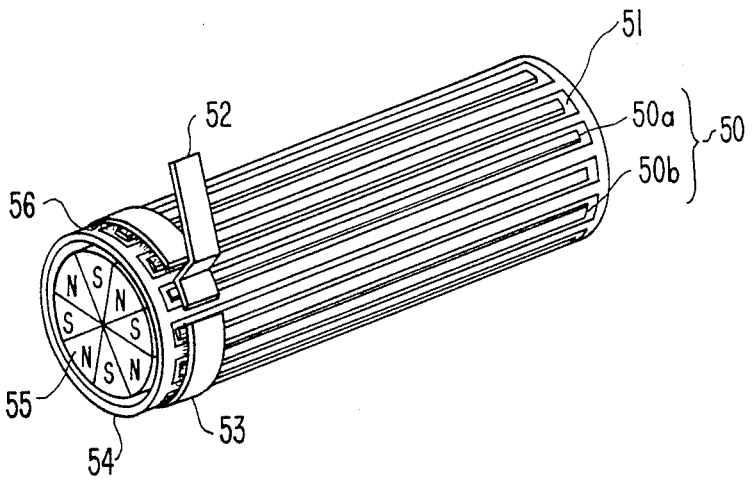
FIG. 16 is a perspective view of a magnetic brush developer of a third embodiment.
Figure 17:
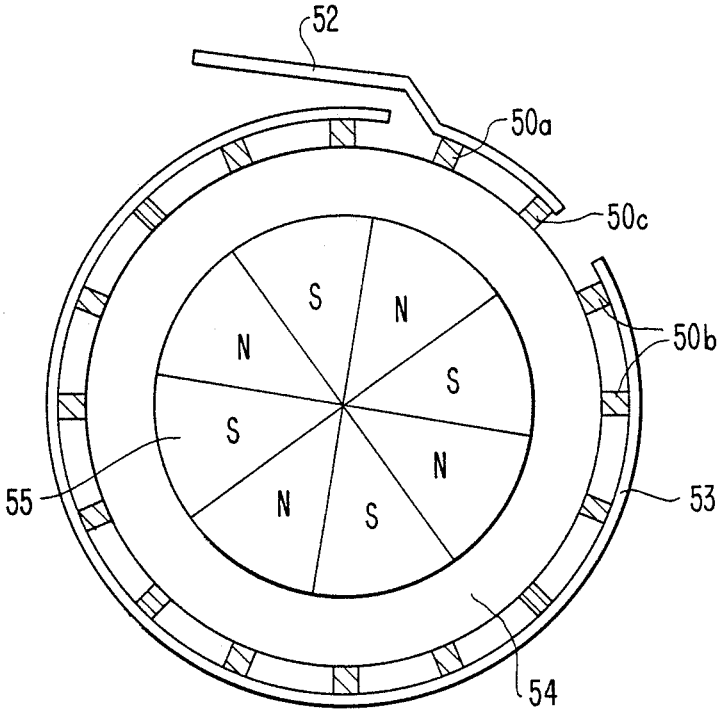
FIG. 17 is a side view of a magnetic brush developer of a fourth embodiment.

FIG. 16 is a perspective view of a magnetic brush developer of a third embodiment. A sleeve 54 and a magnet roller 55 are arranged co-axially, and both are rotatable. Stripe-like recording electrodes 50 are attached to the surface of the sleeve 54, extend in the longitudinal direction of the sleeve 54, and are electrically isolated from the sleeve 54 and from other recording electrodes by insulating films 51 of polyimide which are individually inserted between each recording electrode 50 and the sleeve 54. Of course, an insulating layer covering the whole cylindrical surface of the sleeve 54, commonly isolating the recording electrodes 50, may be used. A recording contact terminal 52, desirably made of a conductive spring material such as phosphor copper, is disposed in contact with at least one of the recording electrodes 50 (in FIG. 16, 50*a* designates one such recording electrode in contact with recording contact terminal 52). If a "make-before-break" contact is desired, a second recording electrode 50*c* would come into contact with recording contact terminal 52 before recording electrode 50*a* goes out of contact with recording contact terminal 52, as shown in FIG. 17. A scavenging contact terminal 53 is formed as a ring-like elastic electrode made of phosphor copper. A portion of the ring is cut away, allowing the presence of the recording contact terminal 52 which directly contacts the recording electrode 50*a*. The scavenging contact terminal 53 contacts the other recording electrodes (50*b*) by contacting furs or filaments 56 which are fastened to the inner surface of the terminal ring. The top surfaces of the recording electrodes 50*b* are bridged to the scavenging terminal 53 via the furs 56. These furs 56 are made of conductive rayon fibers, carbon fibers, and metal fibers. Although the recording electrodes 50 shown in the figure are disposed on the sleeve 54 projecting from the surface of the sleeve 54, it is desirable that the recording electrodes 50 be embedded into the sleeve 54 such that only the top surfaces of the recording electrodes 50 are on the cylindrical outer surface of the sleeve 54. This is for the convenience of scraping attached nonconductive toner particle layers, which are generated during a long period of operation, from the surface of the sleeve 54.

In the above description, there have been described electrophotographic printing apparatuses according to the present invention, however, the invention is also applicable to a display device wherein an optical image is formed directly on a semi-transparent screen.

The present invention has been described by referring to several embodiments, however, modification of the present invention within the scope of the subject matter of the present invention is possible. Since numerous modifications and changes will readily occur to those skilled in the art, it is not desired to limit the invention to the exact construction and application shown and described, and accordingly, all suitable modifications and equivalents may be resorted to, falling within the scope of the invention and the appended claims and their equivalents.

What is claimed is:

1. An electrophotographic image forming device, comprising:

a photosensitive film moving in a first direction including a charge trapping layer having trapped charges producing a latent image; and a developer, adjacent to said photosensitive film and applying a toner to said photosensitive film, said developer including extending means for rotationally extending a contact region between said toner and said photosensitive film, said extending means comprising a toner carrier rotating in a second direction opposite said first direction.

2. An electrophotographic image forming device according to claim 1, said toner being magnetically conductive and said extending means including magnetic means for creating magnetic flux paths which extend the contact region.

3. An electrophotographic image forming device according to claim 2, said developer further including a recording electrode fixedly attached to said developer adjacent to said photosensitive film and separated from said photosensitive film by a predetermined distance.

4. An electrophotographic image forming device according to claim 3, further comprising an optical imaging source emitting an optical beam, exposing said photosensitive film to said optical beam and creating the trapped charge latent image.

5. An electrophotographic image forming device according to claim 4, the toner comprising single-component toner particles.

6. An electrophotographic image forming device according to claim 4, the toner comprising two-component particles including electrically non-conductive toner particles and magnetic toner carriers.

7. An electrophotographic printing apparatus, comprising:

a photosensitive member movable in a first direction and including a transparent or semi-transparent electrode; and a photoconductive layer formed thereon; developing means for forming a layer of charged developing material on said photosensitive medium and including a sleeve;

a magnetic brush having a height and being made of said developing material, contacting the top surface of said photosensitive member and being rotatable in a second direction opposite the first direction; and a recording electrode, disposed on said sleeve and electrically insulated therefrom, and adjacent to said photosensitive member, the area of said photosensitive member directly opposite said recording electrode defining a first region;

a first voltage source for supplying a bias voltage of a first polarity with respect to said transparent or semi transparent electrode, to said recording electrode;

a second voltage source for supplying a bias voltage, of a second polarity opposite said first polarity, to said sleeve; and an optical imaging source emitting an optical beam, selectively exposing a surface of said first region of said photosensitive member to said optical beam to form a latent image in said photosensitive member, so that a first accumulation of said developing material is formed on said first region and a second accumulation of said developing material is formed on a second region of said photosensitive member larger than and adjacent to said first region and located downstream of said first region.

8. An electrophotographic printing apparatus according to claim 7, wherein the distance between said recording electrode and the top surface of said photosensitive member is smaller than the height of said magnetic brush.

9. An electrophotographic printing apparatus according to claim 8, wherein the developing materials are singlecomponent toner particles comprising magnetically conductive toner particles and said sleeve is a stationary non-magnetic material.

10. An electrophotographic printing apparatus according to claim 8, wherein the developing materials are two-component particles including non-conductive toner particles and magnetic toner carriers, and said sleeve is a stationary nonmagnetic material.

11. An electrophotographic printing apparatus according to claim 7, wherein said electrophotographic printing apparatus further comprises:

a magnetic roller generating a magnetic field and rotatably provided in said sleeve co-axially; and a magnetic means for modifying the magnetic field generated by said magnetic roller, said photosensitive member being disposed between said magnetic means and said recording electrode.

12. An electrophotographic apparatus according to claim 11, wherein the accumulation of developing material is formed by said modified magnetic field and is densely concentrated over said second region of said photoconductive layer .

13. An electrophotographic printing apparatus according to claim 12, wherein a third accumulation of developing material is formed in contact with the top surface of said photosensitive layer being located at a position upstream from said first region of movement of said photosensitive member and in the proximity of said second region, eliminating residual developing material remaining on the top surface of said photosensitive member.

14. An electrophotographic printing apparatus according to claim 7, wherein said first region and said second region are connected to each other.

15. An electrophotographic printing apparatus according to claim 7, wherein said developing material comprises two-component toner particles including non-conductive magnetic toner particles and ferromagnetic toner carriers and said sleeve of said magnetic developing means is a rotatable non-magnetic material.

16. An electrophotographic printing apparatus recited in claim 15, wherein said electrophotographic printing apparatus further comprises:

a plurality of stripe-like recording electrodes disposed on the surface of said sleeve parallel to the axis of rotation of said sleeve, and individually insulated electrically from said sleeve and from each other;

a first stationary terminal electrically contacting to at least one of said recording electrodes located in said first region; and a second stationary terminal, having a ring-like shape, surrounding and electrically contacting said recording electrodes except any recording electrode contacting said first stationary terminal.

17. An electrophotographic printing apparatus according to claim 16, wherein said second stationary terminal includes conductive fur materials, disposed on the inner surface of said second stationary terminal, electrically contacting said recording electrodes.

18. A method of electrophotography for use with an electrophotographic image forming device including a photosensitive member, a magnetic developing means having a magnetic brush, a developing means having a sleeve, a recording electrode attached to said sleeve, an optical imaging source for emitting an optical beam, and a means for scavenging, comprising the steps of:

(a) simultaneously moving a photosensitive member and a magnetic brush of a magnetic developing means in opposite directions, said photosensitive member and said magnetic brush being in rubbing contact with each other;

(b) applying a first bias voltage to a recording electrode arranged on a sleeve of said developing means;

(c) applying a second bias voltage having a polarity opposite to that of said first bias voltage to said sleeve;

(d) projecting an optical beam onto a portion of said photosensitive member and forming an electrostatic latent image in said photosensitive member;

(e) forming a solid image of said developing material on said photosensitive member;

(f) scavenging extraneous developing material on said photosensitive member; and (g) recording said image on a recording medium.

19. A method of electrophotography using an electrophotographic image forming device having a photosensitive film, a developer applying a conductive toner to said photosensitive film, the developer including exterior means for rotationally extending a contact region between said toner and said photosensitive film, and an optical imaging source emitting an optical beam, comprising the steps of:

(a) moving the film in a first direction;

(b) rotating the developer in a second direction opposite to said first direction while the toner is in contact with the film;

(c) rotationally extending the contact region between the toner and the photosensitive film; and (d) projecting a beam causing the toner to adhere to the film.

* * * * *

UNITED STATES PATENT AND TRADEMARK OFFICE

CERTIFICATE OF CORRECTION

PATENT NO. : 4,804,994

DATED : February 14, 1988

INVENTOR(S) : Sasakit al.

It is certified that error appears in the above-identified patent and that said Letters Patent is hereby corrected as shown below:

Col. 4, line 24, after "developer", delete ".";

Col. 7, line 23, change "e" to --electrically--;

Col. 17, line 14, "semi transparent" should be --semi-transparent--;

line 35, "singlecomponent" should be --single-component--;

line 42, "nonmagnetic" should be --non-magnetic--.

Signed and Sealed this

Eighteenth Day of July, 1989

*Attest:*

*Attesting Officer*

DONALD J. QUIGG

*Commissioner of Patents and Trademarks*